United States Patent [19]

Kennedy

[11] Patent Number: 4,785,656

[45] Date of Patent: Nov. 22, 1988

[54] CRIMPING MACHINE FOR HOSE AND FITTING ASSEMBLIES

[75] Inventor: Robert L. Kennedy, Fort Worth, Tex.

[73] Assignee: Stratoflex, Inc., Fort Worth, Tex.

[21] Appl. No.: 78,259

[22] Filed: Jul. 27, 1987

Related U.S. Application Data

[63] Continuation-in-part of Ser. No. 914,191, Oct. 1, 1986, abandoned.

[51] Int. Cl.[4] ..... B21D 39/04; B21D 41/04

[52] U.S. Cl. ..... 72/402; 29/237

[58] Field of Search ..... 72/402, 416, 415, 407, 72/409, 410, 452, 472, 433, 434; 29/237, 243.52, 282

[56] References Cited

U.S. PATENT DOCUMENTS

| | | | |
|---|---|---|---|
| 1,701,250 | 2/1929 | Young . | |
| 1,782,219 | 11/1930 | Wallace . | |
| 2,231,278 | 2/1941 | Miller . | |
| 2,939,505 | 6/1960 | Bucher et al. | 72/402 |
| 2,974,367 | 3/1961 | Doering et al. | 72/402 |
| 3,135,310 | 6/1964 | Stoltz . | |
| 3,172,211 | 3/1965 | Morris | 72/409 |
| 3,455,140 | 7/1969 | Galan et al. | 72/402 |
| 3,575,036 | 4/1971 | Hoffman et al. | 72/402 |
| 3,706,219 | 12/1972 | Hoffman et al. | 72/402 |
| 3,731,518 | 5/1973 | Blocher | 72/402 |
| 3,736,788 | 6/1973 | Olive-Jones et al. | 72/402 |
| 4,250,607 | 2/1981 | Lillbacka et al. | 72/402 |
| 4,339,940 | 7/1982 | MacKay et al. | 72/402 |
| 4,464,917 | 8/1984 | Kienhofer | 72/402 |
| 4,577,485 | 3/1986 | Moreiras | 72/402 |

FOREIGN PATENT DOCUMENTS

| | | |
|---|---|---|
| 710088 | 5/1965 | Canada . |
| 60-92016 | 5/1985 | Japan . |

*Primary Examiner*—Daniel C. Crane

*Attorney, Agent, or Firm*—Marshall, O'Toole, Gerstein, Murray & Bicknell

[57] ABSTRACT

This disclosure relates to a crimp head for a crimp machine particularly suited for crimping hose and fitting assemblies, the head comprising two die halves which are movable on a line of movement toward and away from each other. Each of the die halves comprises a web and a support for the web, and each web forms a plurality die guideways. The head further comprises a set of substantially identical dies, half of the dies being slidably mounted in the guideways of each web. The halves are movable on the line between an open position wherein a fitting to be crimped may be mounted on a fitting axis between the halves, and a crimp position wherein the halves close together and crimp the fitting. The fitting axis is substantially perpendicular to the line of movement of the halves, and the dies are movable in the webs radially of the axis. Each half further comprises a pusher having a V-shaped surface for engaging the dies and pushing them against the fitting. A crimp head may be mounted in a portable hand-held crimp machine, or a plurality of crimp heads may be mounted in a multiple-head machine, the crimp heads being designed for different size fittings. The multiple-head machine has one operating station, and the heads are selectively movable to this station.

10 Claims, 5 Drawing Sheets

FIG. 6
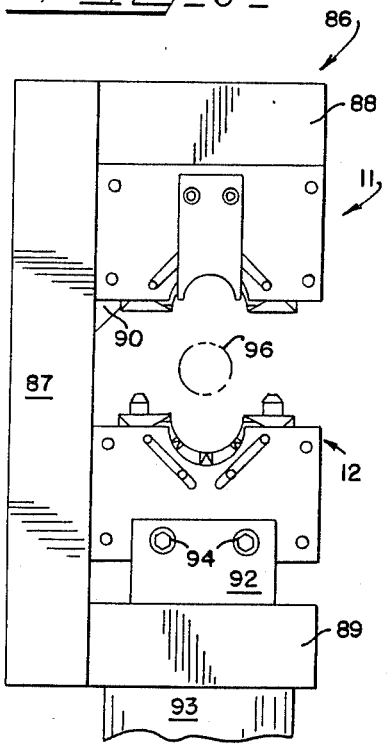
FIG. 7
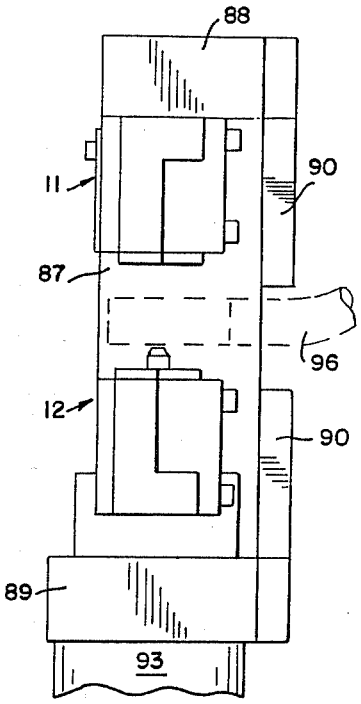
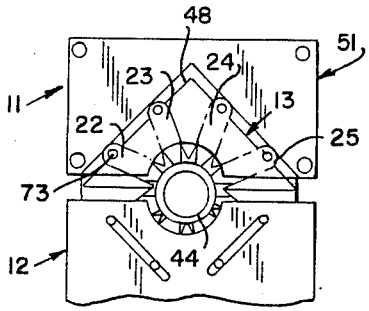
FIG. 4
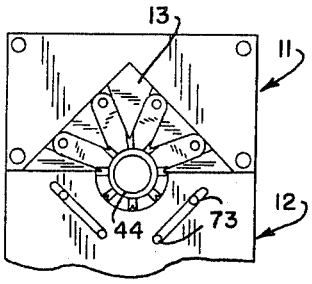
FIG. 5

CRIMPING MACHINE FOR HOSE AND FITTING ASSEMBLIES

RELATED PATENT APPLICATIONS

This application is a Continuation-In-Part of R. L. Kennedy application Ser. No. 914,191 filed Oct. 1, 1986 and titled Crimping Machines For Hose and Fitting Assemblies, now abandoned.

FIELD AND BACKGROUND OF THE INVENTION

This invention relates to a machine for crimping fittings on hose, and more particularly to a crimp machine that is relatively simple in construction and is relatively small and lightweight and therefore suited for use in the field.

Many designs of crimp machines have been provided in the past for crimping a socket of a hose fitting in order to secure the fitting to the hose. Such machines normally include a set of crimp dies which are arranged in a circle around a fitting to be crimped, and a hydraulically powered mechanism for forcing the dies against the socket of the fitting. Most crimp machines of this nature are relatively large and are operated at factories and distributor locations, because of their size and weight. Smaller crimp machines have, however, been provided, which are suitable for use in the field, but they have been relatively complex in construction and therefore expensive to manufacture.

For example, U.S. Pat. No. 3,731,518 to G. L. Blocker describes a crimp machine for assembling hose fittings. The Blocker machine includes a set of dies mounted on two die support bodies, and a mechanism for moving the two bodies together in order to confine and then crimp a fitting positioned between the bodies. The machine described in the Blocker patent is disadvantageous in that it includes relatively complex mechanisms, and the dies of the set are not all identical, thereby requiring an inventory of numerous repair parts and different designs of dies.

It is a general object of the present invention to provide an improved crimp machine which avoids the foregoing disadvantages.

SUMMARY OF THE INVENTION

This invention relates to a crimp head for a crimp machine particularly suited for crimping hose and fitting assemblies, the head comprising two die halves which are movable on a line of movement toward and away from each other. Each of the die halves comprises a web and a support for the web, and each web forms a plurality die guideways. The head further comprises a set of substantially identical dies, half of the dies being slidably mounted in the guideways of each web. Each half further comprises a pusher having a V-shaped surface for engaging the dies and pushing them against the fitting. The halves are movable on the line of movement between an open position wherein a fitting to be crimped may be positioned on a fitting axis between the two halves, and a crimp position wherein the halves close together and crimp the fitting. The fitting axis is substantially perpendicular to the line of movement of the halves, and the dies are movable in the webs radially of the axis.

A crimp head may be mounted in a portable hand-held crimp machine, or a plurality of crimp heads may be mounted in a multiple-head machine, the various crimp heads being designed for different size fittings. The multiple-head machine has one operating station, and the heads are selectively movable to this station.

BRIEF DESCRIPTION OF THE DRAWINGS

The invention will be better understood from the following detailed description taken in conjunction with the accompanying figures of the drawings, wherein:

FIG. 4 is a view similar to FIG. 1 but showing the crimp head in the closed position;

FIG. 5 is a view similar to FIGS. 1 and 4 but showing the crimp head in the crimp position;

FIG. 6 is a front view showing the crimp head mounted in a portable, hand-held crimp machine;

FIG. 7 is a side view of the machine shown in FIG. 6;

DETAILED DESCRIPTION OF THE DRAWINGS

Figure 3:
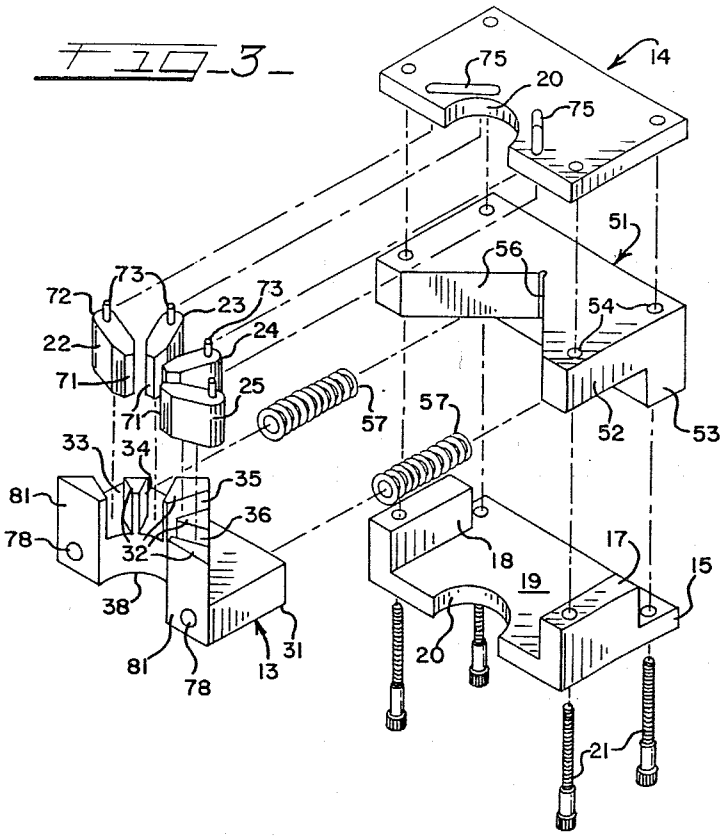
FIG. 3 is an exploded view of one-half of the crimp head.
Figure 1:
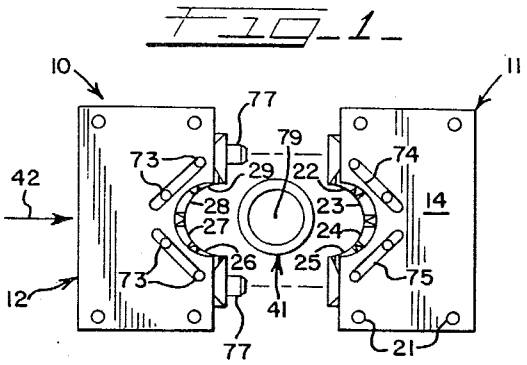
FIG. 1 is a plan view of a crimp head in accordance with the invention, in the open position.
Figure 2:
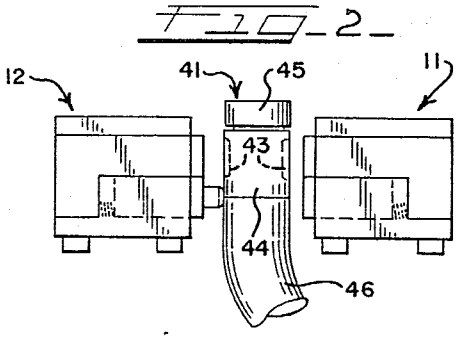
FIG. 2 is a side view of the crimp head shown in FIG. 1.

With reference first to FIGS. 1, 2 and 3, a crimp head 10 in accordance with the invention comprises two halves 11 and 12, the half 11 being shown in detail in FIG. 3. The half 11 comprises a web 13 and a support for the web 13, the support including a front plate 14 and a rear plate 15. The rear plate 15 includes upstanding side walls 17 and 18 which form a relatively large slot 19 between them, and the web 13 is positioned between the walls 17 and 18 and is slidably mounted within the slot 19. The front plate 14 is positioned on the upper surfaces of the two walls 17 and 18, and a plurality of bolts 21 secure the front and rear plates together with the web 13 between them. The front and rear plates 14 and 15 have semi-circular openings 20 which form a circle when the two halves are together. As shown in FIGS. 4 and 5, this circle is larger than the diameter of a fitting to be crimped, whereby the plates 14 and 15 are out of engagement with and do not confine the fitting.

The crimp machine further comprises a set of substantially identical dies, there being a total eight dies 22 through 29 in the specific example illustrated and described in FIGS. 1 to 5. Four of the dies 22–25 are mounted in the half 11 and the remaining four dies 26–29 are mounted in the other half 12, and the dies are mounted for slidable movement in die guideways formed in the webs of the two halves. With specific reference to FIG. 3, the web 13 includes a substantially rectangular plate portion 31 and a plurality of posts 32, the posts 32 being spaced apart and forming the guideways 33, 34, 35 and 36 between them. The height of the plate portion 31 of the web 13 is substantially equal to the height of the walls 17 and 18 of the rear plate 15. Further, a semicircular recess or cutout 38 is formed in the forward side of the web 13, which is the side that faces the web of the other half 12, and the recess 38 extends through the plate portion 31 and the posts 32. The radius of the semicircular recess 38 in each of the two halves 11 and 12 and the semicircular recesses of the front plate 14 and the rear plate 15 are larger than the radius of a fitting 41 to be crimped, so that the fitting may be moved in the recesses after the halves have moved together but before the dies engage the fitting. Thus the fitting is not confined by the die halves (nor is it confined by the plates 14 and 15) and its position can be adjusted.

The two halves 11 and 12 are movable relative to each other along a line or direction 42 (FIG. 1) toward or away from each other between an open position shown in FIG. 1 where the fitting 41 may be positioned between the two halves 11 and 12, to a closed position shown in FIG. 4 where the two halves are moved together and the recesses 38 of the two webs are closely adjacent the outer surface of the fitting 41, and a crimp position shown in FIG. 5 where the two halves 11 and 12 engage each other and the dies of the two halves crimp the fitting. With reference to FIG. 2, the solid line illustration of the fitting 41 illustrates the size before crimping, and the dashed lines 43 illustrates the shape of a portion of a portion of the socket of the fitting after crimping.

The fitting 41 may be a conventional type including an outer socket 44 and a nipple 45. The nipple is inserted into the end of a length of hose 46 and the socket 44 extends around the end of the hose, and by crimping the socket 44 to the dashed line 43 position, the end of the hose 46 is tightly compressed between the nipple and the socket and thereby secured to the fitting.

With reference once again to FIG. 3, the rearward sides 48 of the posts 32 are angled to form a V configuration which is best illustrated in FIGS. 4 and 5. Each half of the crimp head further includes a pusher 51 which includes a flat upper plate portion 52 and a downwardly extending flange 53 at the rearward side of the pusher. The plate portion 52 engages the upper surfaces of the two walls 17 and 18 of the rear plate 15 and the bolts 21 extend through holes 54 in the pusher and through corresponding holes in the front and rear plates in order to secure the pusher 51 to the front and rear plates. The flange 53 of the pusher extends downwardly behind or to the rear of the two walls 17 and 18. The forward side of the plate portion 52 has a cutout forming a V-shaped surface 56 which is located closely to the rear of the associated web 13, the two V's having similar angles as shown in FIGS. 3 and 4.

A pair of compression springs 57 are mounted between the rearward surface of the plate portion 31 of each web and the forward surface of the flange 53 of the associated pusher 51, whereby each web is urged in the forward direction relative to the pusher 51 (and relative to the front and rear plates).

With specific reference to FIG. 4, the four dies 22–25 of each half are sufficiently long that they extend beyond both ends of the associated guideways 33–36 in which they are mounted. FIG. 4 shows that, when the web 13 is moved forwardly by the action of the two compression springs 57, the front faces 71 of the dies are spaced forwardly slightly from the front surface of the arcuate recess 38 of the associated web 13, and the rearward ends 72 of the dies project rearwardly slightly from the angled backsides of the posts 32. The rearward ends 72 of the dies are rounded and these rounded ends engage the V-shaped surface of the pushers 51.

Projecting upwardly from the upper surface of each die 22–25 is a guide pin 73, the pin of each die being located, in the present specific example, near the curved rearward ends 72 of the dies. The front plate 14 of each half has two slots 74 and 75 formed in it, and the pins 73 extend into the slot 74 and the pins of the dies 24 and 25 extend into the slot 75. As shown in FIGS. 1 and 3, the two slots 74 and 75 are slanted at essentially the same angles as the surface 56 of the pusher 51 and the V-shaped rearward sides of the posts 32. When the web 13 is pushed forwardly by the springs 57 to the forward position shown in FIG. 1, the pins 73 of the outside dies 22 and 25 are located at the forward ends of the two slots 74 and 75 whereas the pins of the two inside dies 23 and 24 are located intermediate the ends of the slots. Thus, the pins 73 engage the slots and serve to retain the dies 22–25 and the web 13 of each half within the enclosure formed between the front and rear plates of the support.

To guide the halves to the proper locations relative to each other during a crimping operation, two alignment pins 77 are preferably formed on the forward side of the web 13 of one half 12, and two pin receiving holes 78 are formed in the web 13 of the other half 11, the holes 78 being aligned with the pins 77. Consequently, when the half 10 is moved toward the half 11, the pins 77 enter the holes 78 and thereby maintain the dies in proper alignment during the crimp operation.

In the operation of the crimp head, the two halves 10 and 11 are normally in the open or spaced positions illustrated in FIGS. 1 and 2. While in the open position, a hose and fitting assembly to be crimped is positioned between the two halves 10 and 11, the fitting axis 79 (FIG. 1) being substantially perpendicular to the plane of the line of movement 42, and the fitting being between the forward faces 71 of the set of dies. While holding the fitting 41 in this position, the two halves 11 and 12 are moved together to the closed position shown in FIG. 4, and during this movement the pins 77 enter the holes 78 and the forward surfaces 81 of the two webs 13 engage. The forward surfaces 71 of the dies also engage the sides of the socket 44 of the fitting. A force is then applied to continue the movement of the two halves 11 and 12 toward each other to the crimp position shown in FIG. 5, and during this continued movement the two webs 13 are moved rearwardly in the slots against the forces of the compression springs 57. The angled surfaces 56 of the pushers 51 press against the rearward ends 72 of the dies, and the engagement between the sides of the guideways 33–36 with the sides of the dies as the webs move rearwardly causes the dies to slide in the guideways radially inwardly toward the axis 79. Movement of the two halves 11 and 12 toward each other continues until the V-shaped surfaces 56 of the pushers 51 engage the angled sides of the posts 32 and halt continued movement. In this position the faces of the dies are further extended from the guideways 33–36 and are pressed into the socket 44 in order to crimp or deform the socket to the dashed line shape 43 shown in FIG. 2.

The force on the two halves 11 and 12 is then removed and the two halves are separated again to the open position shown in FIG. 1, thereby allowing the fitting to be removed. As the two halves move away from each other, the springs 57 move the webs 13 to the forwardmost position shown in FIG. 1, and the dies 22–25 slide radially outwardly in the guideways, their movements being guided by the sides of the posts 32 and the slots 74 and 75 of the front plate.

FIGS. 6 and 7 illustrate an embodiment of the invention wherein the crimp head 10 is mounted in a relatively small and lightweight crimp machine which is suitable for use in the field. The machine 86 comprises a C-shaped frame including a vertical (as seen in FIGS. 6–7) plate 87 and upper and lower side plates 88 and 89, the three plates 87–89 being rigidly secured together. The connection of the two sides 88 and 89 to the vertical plate 87 is strengthened by two triangular braces 90 which extend between the corners and interconnect the plates 87–89.

The head half 11 is secured to the side plate 88 and the other half 12 is secured to the upper end of a ram or piston 92 of a power unit such as a hydraulic cylinder 93. The hydraulic cylinder 93 is mounted on the underside of the lower plate 89 and the ram 92 extends upwardly through a suitable opening (not shown) formed through the plate 89, the head 12 being secured to the ram by bolts 94.

To operate the crimp machine, a fitting 96 is positioned between the dies of the two halves 11 and 12, the hydraulic cylinder 93 is activated to cause the half 12 to be moved upwardly toward the half 11, and the two halves crimp the fitting 96 as previously described. It will be apparent from FIGS. 6 and 7 that an operator of the crimp machine has ready access to the space between the halves 11 and 12 in order to easily locate the fitting between the two halves, and the machine may even be easily used to crimp elbow or curved fittings.

Figures 8, 9:
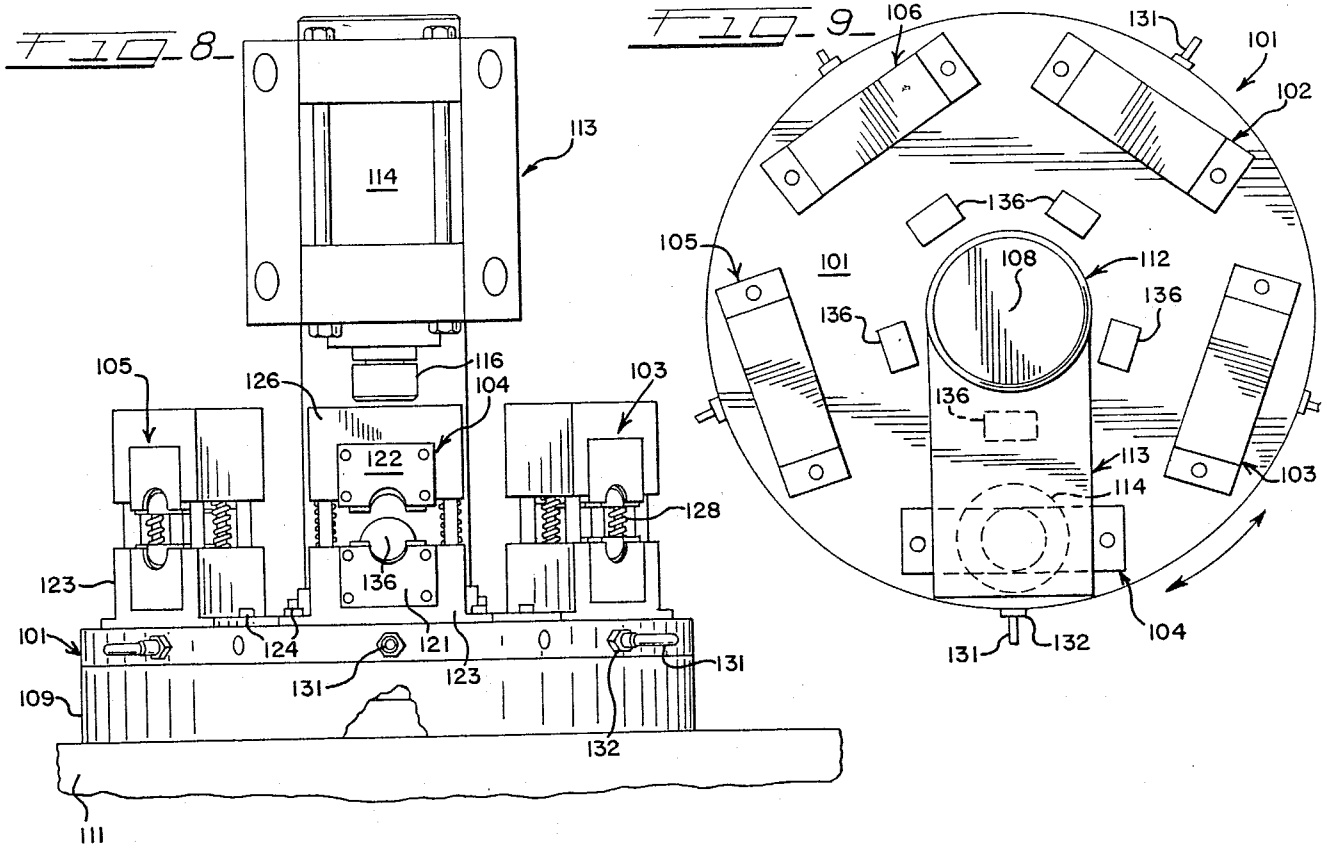
FIG. 8 is a front view of a multiple-head machine including a plurality of crimp heads.
FIG. 9 is a plan view of the machine shown in FIG. 8.

FIGS. 8 and 9 show a multiple crimp head machine which is particularly suitable for use at a job site along an assembly line or at a location where hose and fitting assemblies of different sizes are required. For example, during the manufacture of a cab for a truck, the individuals assembling the parts require hose and fittings of different sizes. In this instance, a machine of the character shown in FIGS. 8 and 9 may be installed at the job site together with unassembled hose and fittings of different sizes, and the individuals may use the machine shown in FIGS. 8 and 9 to assemble the different sizes without the need for changing the dies of the crimp machine.

The head half 11 is secured to the side plate 88 and the other half 12 is secured to the upper end of a ram or piston 92 of a power unit such as a hydraulic cylinder 93. The hydraulic cylinder 93 is mounted on the underside of the lower plate 89 and the ram 92 extends upwardly through a suitable opening (not shown) formed through the plate 89, the head 12 being secured to the ram by bolts 94.

To operate the crimp machine, a fitting 96 is positioned between the dies of the two halves 11 and 12, the hydraulic cylinder 93 is activated to cause the half 12 to be moved upwardly toward the half 11, and the two halves crimp the fitting 96 as previously described. It will be apparent from FIGS. 6 and 7 that an operator of the crimp machine has ready access to the space between the halves 11 and 12 in order to easily locate the fitting between the two halves, and the machine may even be easily used to crimp elbow or curved fittings.

FIGS. 8 and 9 show a multiple crimp head machine which is particularly suitable for use at a job site along an assembly line or at a location where hose and fitting assemblies of different sizes are required. For example, during the manufacture of a cab for a truck, the individuals assembling the parts require hose and fittings of different sizes. In this instance, a machine of the character shown in FIGS. 8 and 9 may be installed at the ]ob site together with unassembled hose and fittings of different sizes, and the individuals may use the machine shown in FIGS. 8 and 9 to assemble the different sizes without the need for changing the dies of the crimp machine.

With reference specifically to FIGS. 8 and 9, the machine comprises a rotary table 101, having in the present illustration, five crimp heads 102–106 mounted on the upper surface thereof. The rotary table 101 is mounted for rotation on an axis 108 at the center of the table, the table 101 being rotatable on a stand 109 which, in turn, is mounted on a suitable support such as a table 111.

Extending upwardly from the center or axis of the table is a cylindrical post 112. The lower end of the post 112 extends downwardly through an opening in the table 101 and it is rigidly secured to the stand 109. While the table 101 is rotatable on the stand 109, the post 112 is stationary. Mounted on one side of the post 112 is a frame 113 that supports a hydraulic cylinder 114. The cylinder 114 extends substantially vertically and it has a piston or ram 116 that projects downwardly from the lower end of the cylinder 114. The piston or ram 116 is movable between a retracted position illustrated in FIG. 8 and an extended position where it engages a crimp head during a crimping operation.

The five crimp heads 102–106 are constructed as illustrated and described in FIGS. 1–5 but they include different sizes of crimp dies and webs. The different heads are designed to crimp five different sizes of fittings, as will be described.

Each crimp head includes a lower half 121 and an upper half 122, the lower half 121 being mounted in a frame 123 which is secured by bolts 124 to the upper surface of the table 101. The upper half 122 of each head is mounted in another frame 126, and the two frames 123 and 126 for each crimp head are movably connected together by four guide shafts 127 which extend vertically from the corners of the frames and guide the movement of the upper half 122 in the vertical direction. Compression springs 128 are also mounted between the two frames 123 and 126 and normally hold the upper half 122 and the frame 126 displaced upwardly from the lower half 121. Due to the presence of the guide shafts 127, the guide pins 77 and the holes 78 described in connection with FIGS. 1–5 are not required.

As best illustrated in FIG. 9, the radius from the axis 108 to the frames 123 and 126 and each crimp head is essentially the same as the distance from the axis 108 to the ram 116. Consequently by rotating the table 101 and the crimp heads on the axis 08, a selected crimp head may be positioned directly under the ram 116. When the hydraulic cylinder 114 is actuated to extend the ram 116, the ram moves downwardly and engages the frame 126 and forces the upper crimp half 122 downwardly and thereby moves the halves to the crimp position, as described in connection with FIGS. 1–5.

For the convenience of the operator of the machine, a plurality of assembly pins 131 are mounted on the outer periphery of the rotary table 101, one of the pins 131 being located in front of each of the crimp heads 102–106. Each assembly pin 131 is fastened to the side of the rotary table 101 by a bolt 132, and the pins 131 are sized to receive the nipples of the fittings to be assembled. During an assembly operation, the operator slides a socket over an end of a length of hose, positions the associated nipple on an assembly pin 131 associated with the crimp head to be used and then pushes the end of the hose over the nipple. The hose and the nipple are then removed from the assembly pin, the socket is positioned around the nipple, and the fitting is mounted between the die halves as previously described.

To assist the operator in properly locating the fitting relative to the die halves, a stop 136 is mounted on the upper side of the table 101 behind each of the crimp heads. As shown in FIG. 9, for each crimp head the stop 136 extends upwardly from the table and above the axis of a fitting to be crimped when the fitting is properly located between the die heads.

Considering the operation of the crimp machine shown in FIGS. 8 and 9, the machine is mounted at a job site and the five crimp heads 102–106 are equipped with different sizes of dies and webs, the sizes being for the most commonly used fitting sizes to be assembled at the job site. To assemble a hose and fitting of a specific size, the operator rotates the rotary table 101 in order to position the crimp head for that size of fitting underneath the ram 116. A pin-detent or lock arrangement may be provided to releasably hold the table 101 at a selected position. The operator then slides the socket of the fitting over the end of the hose, positions the nipple on the pin 131 associated with that crimp head, forces the hose over the nipple while standing in front of the machine and slides the socket over the nipple. The operator then, with the ram 116 and the upper half 122 displaced upwardly as shown in FIG. 8, positions the fitting between the crimp halves 121 and 122. To properly locate the fitting, the operator moves the fitting inwardly until it meets the stop 136. The operator then, by pressing a foot pedal for example, actuates the hydraulic cylinder 114 and causes the ram 116 to move downwardly and force the two crimp halves 121 and 122 together. The fitting is thereby crimped, and thereafter the operator actuates the hydraulic cylinder 114 to retract the ram 116. The upper head 122 also rises due to the springs 128 and the operator is then able to remove the completely assembled hose and fitting from the crimp head. For a different size fitting, the operator simply rotates the table 101 to position the appropriate crimp head under the ram.

FIGS. 10 to 14 illustrate a crimp head 151 according to another embodiment of the invention. The crimp head 151 comprises two halves 152 and 153, the half 152 being shown in more detail in FIGS. 10, 13 and 14. The half 152 includes a web 156, identical dies 157*a*, 157*b* and 157*c* which are slidably mounted on the web 156, a pusher 158, and front and rear plates 159 and 160. The parts 156 to 160 are generally similar in construction and operation to the correspondingly named parts of the crimp head shown in FIGS. 1 to 5, and therefore only the differences are described in detail.

The halves 152 and 153 include three dies each whereas the halves 11 and 12 include four dies each. With reference to the die half 152, the web 156 has three guideways 161 formed by four posts 162, and the dies are mounted in the guideways. The pusher 158 has a V-shaped surface formed by angled sides 163 and 164 formed thereon which engage the rounded rearward ends of the dies 157*a*, 157*b* and 157*c* (see FIGS. 13 and 14). The center die 157*b* and the center of the three guideways 161 extend parallel to the direction of movement of the halves during a crimping operation, and they extend to the apex of the sides 163 and 164. The other two dies 157*a* and 157*c* move at angles to the direction of movement of the halves and they slidingly engage the angled sides 163 and 164.

Figure 14:
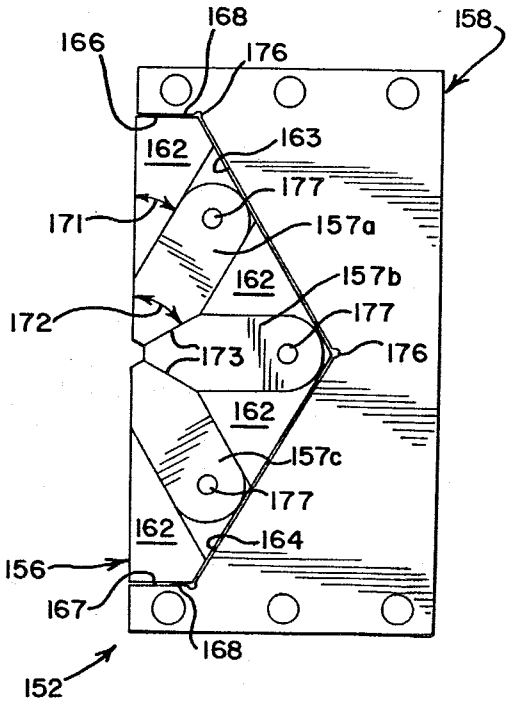
FIG. 14 is similar to FIG. 13 but shows another position of the parts.
Figure 13:
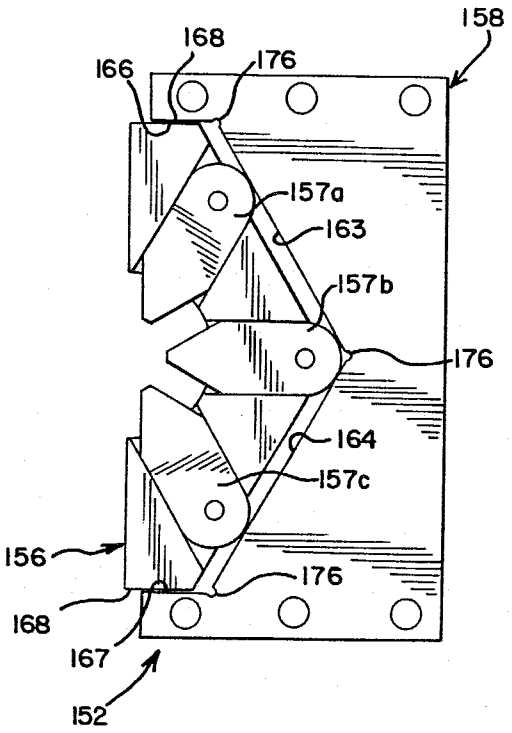
FIG. 13 is a view with a part removed to show one position of the crimp head of FIG. 10.

At the forward ends of the angled sides 163 and 164 of the V-shaped surface are straight sides 166 and 167. These straight sides 166 and 167 slidingly engage the outer sides 168 of the outermost posts 162 of the web 156. As shown in FIGS. 13 and 14, the sides 166, 167 and 168 extend parallel to the direction of movement of the halves 152 and 153, and the sides 166 and 167 guide and help support the web 156.

Whereas the crimp head shown in FIGS. 1 to 5 includes two compression springs 57, the head 157 includes four compression springs 169. Bolts 170 secure the parts together.

With reference to FIGS. 13 and 14, it will be noted that the angles 171 between the forward face of the web and the outermost guideways 161 is 30°, and the angles 172 of tapered sides 173 of the forward ends of the dies are 60°. With these angles, when the web and the dies are in the closed or crimp position shown in FIG. 14, the tapered sides 173 are tight against each other and substantially flush with the forward face of the web 156. Further, the crimp faces 174 of the dies are closely adjacent each other with little or no gap between them, as shown in FIG. 14. As a result, relatively even crimping force is applied entirely around a fitting being crimped, and the outer surface of the crimped portion of the fitting forms a well defined hexagonal shape.

Figures 10, 11, 12:
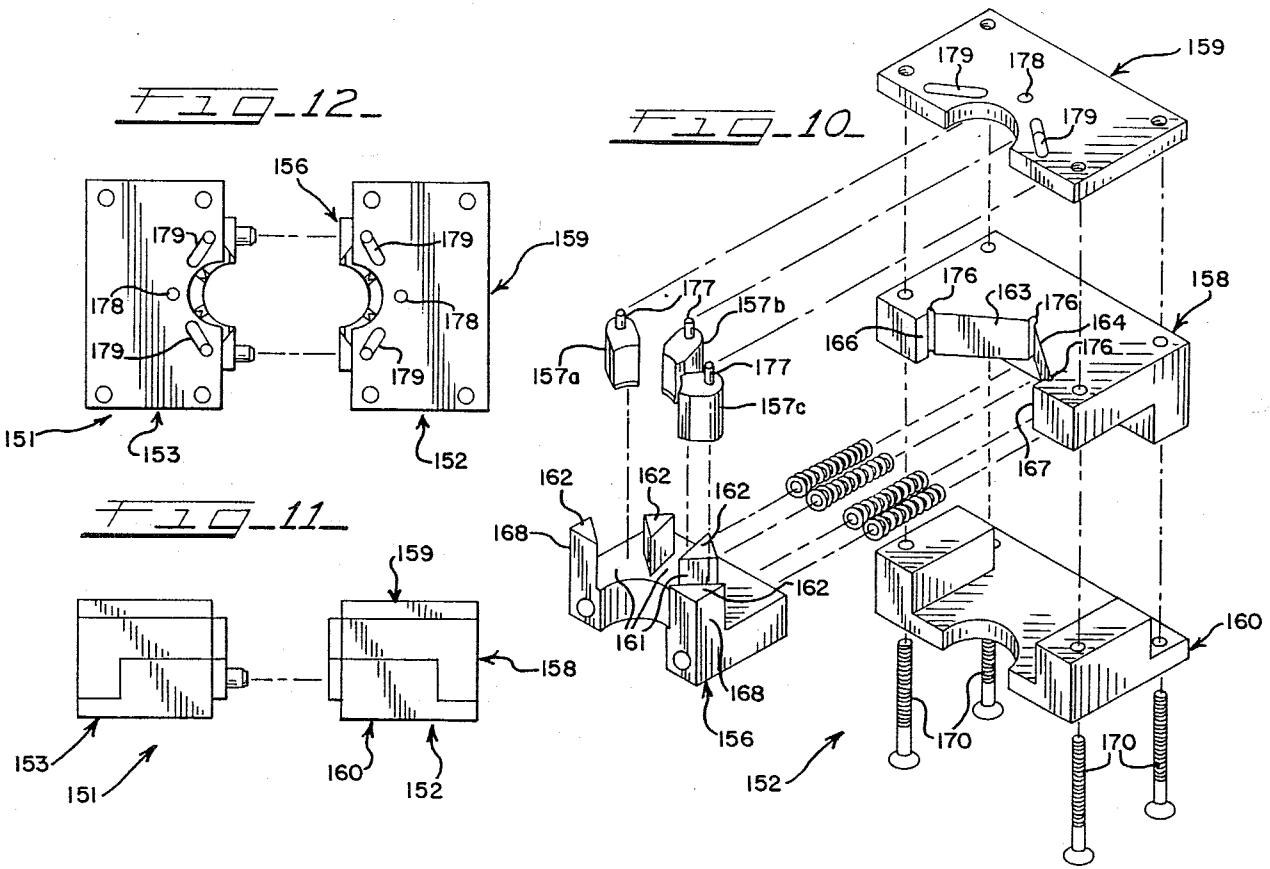
FIG. 10 is similar to FIG. 3 but shows an alternative construction of the crimp head.
FIGS. 11 and 12 are side and plan views of the crimp head of FIG. 10.

As shown in FIGS. 10 and 13, curved portions 176 may be provided at the intersections of the surfaces 163, 164, 166 and 167 of the pushers 158 in order to relieve stresses at these points.

Guide pins 177 are fastened to the upper sides of the dies 157*a*, 157*b* and 157*c*. The pin 177 of the center die 157*b* of each crimp head half is located in a hole 178 formed in the associated front plate 159, and consequently this center die 157*b* is fastened to and moves with the pusher 158. The pins 177 of the two outer dies 157*a* and 157*c*, however, are mounted in elongated slots 179 of the front plate 159, which have the same angles as the surfaces 163 and 164. The pins 177 slide in the slots 179 during a crimping operation, and this interconnection retains the dies and the webs in the halves of the crimp head.

The crimp head shown in FIGS. 10 to 14 may, of course, be mounted in the crimp machines shown in FIGS. 6 to 9.

It will be apparent from the foregoing description and the drawings that a novel and useful crimp head and crimp machines have been provided. In each crimp head, the dies are all identical and the mechanisms for guiding the dies during and after a crimp operation is relatively simple. As a consequence, the crimp head is relatively inexpensive to manufacture and it is sturdy and reliable in operation. The crimp machine shown in FIGS. 6 and 7 is sufficiently small to be readily portable and hand-held. The machine shown in FIGS. 8 and 9 is capable of crimping a variety of sizes of fittings without the need for changing the dies of a crimp head. By use of the crimp machines shown in the drawings, it is possible to decrease the inventory of hose and fitting assemblies required at a job site. This is true because a length of hose may be cut to size at the job site and assembled with a fitting, as opposed to the prior art necessity of keeping an inventory of various lengths and sizes of hose/fitting assemblies at each job site.

What is claimed is:

1. A crimp head of a crimp machine for crimping fittings, said head comprising two die halves at least one of which is movable on a line of movement toward and away from the other, each of said die halves comprising a web and a support for said web, and each web forming a plurality of die guideways, said head further comprising a set of substantially identical dies, half of the dies being slidably mounted in the guideways of each web, said support comprising a pusher having a substantially V-shaped surface for engaging said dies and pushing them against the fitting, said halves being movable on a line of movement between an open position wherein a fitting to be crimped may be positioned on a fitting axis between said two halves, and a crimp position wherein said halves close together and crimp the fitting, said axis of the fitting being substantially perpendicular to said line of movement of the halves, said dies being movable in said webs radially of said axis, said support of each of said halves further comprising plate means on opposite sides of said web and said dies and fixed to said pusher, said web and said dies of each half being movable relative to said support, spring means between each support and web for urging each web out of the support therefore, and projection means separate from said spring means interconnecting each of said dies and said plate means for retaining said dies in said web and maintaining said web in said support.

2. A crimp head as set out in claim 1, wherein said projection means comprises a pin on at least one of said dies and at least one slot on said plate means, said pin being slidably movable in said slot.

3. A crimp head as set out in claim 1, wherein said spring means of each half urges the associated web toward the other half.

4. A crimp head as set out in claim 1, wherein each of said dies comprises a crimp face which is adapted to engage a fitting being crimped, and tapered sides adjacent to and extending away from said crimp face, the portions of said tapered sides adjacent said faces being in close engagement when said dies are in said crimp position.

5. A crimp head as set out in claim 1, wherein each of said halves includes three of said dies and three of said guideways, one of said three dies and guideways being parallel to said line of movement and engaging the apex of said V-shaped surface, and the remaining two of said three dies being angularly spaced from said one die.

6. A crimp head as set out in claim 1, and further comprising a frame, a power unit mounted on said frame and including a ram which is movable on said line of movement, one of said halves being mounted on said frame and the other of said halves being mounted on said ram.

7. A crimp machine according to claim 6, wherein said frame is generally C-shaped and includes a center portion and two arm portions, said power unit being mounted on one of said arm portions and said one-half being mounted on the other of said arm portions.

8. A crimp machine including a plurality of crimp heads as set out in claim 1, comprising a frame, a table rotatably mounted on said frame, a power unit mounted on said frame and including a ram which is movable on a line of movement toward and away from said table, said plurality of crimp heads being mounted on said table between said table and said ram, one of said halves being immovable relative to said table and the other of said halves being engageable by said ram.

9. A crimp machine according to claim 8, wherein said table is rotatable on an axis of rotation to move a selected crimp head into said line of movement.

10. A crimp machine according to claim 9, wherein said plurality of crimp heads have different crimp diameters for different sizes of fittings.

* * * * *